United States Patent [19]

Speggiorin et al.

[11] 3,970,202

[45] July 20, 1976

[54] APPARATUS FOR STACKING FOLDED BOXES

[75] Inventors: Mariano Speggiorin, Renens; Friedrich Wiedemann, Saint-Sulpice, both of Switzerland

[73] Assignee: J. Bobst & Fils S.A., Switzerland

[22] Filed: Sept. 27, 1974

[21] Appl. No.: 510,068

[30] Foreign Application Priority Data

Oct. 25, 1973 Switzerland ..... 15034/73

[52] U.S. Cl. ..... 214/6.5; 214/1 Q; 214/6 C; 271/66

[51] Int. Cl.² ..... B65G 57/16; B65G 57/08

[58] Field of Search ..... 214/1 Q, 6 C, 6 D, 6 S, 214/6.5; 271/64, 66, 70, 72, 83, 186; 93/93 DP

[56] References Cited

UNITED STATES PATENTS

| | | | |
|---|---|---|---|
| 919,387 | 4/1909 | Scott | 271/66 |
| 1,889,846 | 12/1932 | Wright | 214/6 C X |
| 2,485,943 | 10/1949 | Turrall | 214/6 D X |
| 3,070,211 | 12/1962 | Williamson | 214/6.5 X |
| 3,142,388 | 7/1964 | Cole | 271/66 X |
| 3,288,312 | 11/1966 | Hughes et al. | 271/66 X |
| 3,488,693 | 1/1970 | Brinkmeier | 214/6.5 |
| 3,684,274 | 8/1972 | Grantham et al. | 271/66 X |
| 3,851,773 | 12/1974 | Kluge et al. | 214/6.5 |

*Primary Examiner*—L. J. Paperner

*Attorney, Agent, or Firm*—Hill, Gross, Simpson, Van Santen, Steadman, Chiara & Simpson

[57] ABSTRACT

Apparatus for receiving folded boxes from a machine such as a folder-gluer and stacking said folded boxes in one stack but with portions of the stack in alternately disposed directions to avoid an unbalance in overall thickness of said stack, said apparatus including two box receiving stations located in vertically spaced planes, a shiftable conveyor for selectively moving folded boxes to each of said receiving stations and means for turning over a stack of folded boxes deposited in a first station and then depositing same in a second station on top of other folded boxes already deposited in a second station.

13 Claims, 4 Drawing Figures

APPARATUS FOR STACKING FOLDED BOXES

This invention relates to apparatus for stacking folded boxes at the output of a box making machine, such, for example, as at the output of the receiver station of a folder-gluer machine.

Certain types of folded boxes obtained at the receiver station of a folder-gluer machine, for example, exhibit in general a longitudinal section of substantially trapezoidal shape, this being the case in particular with boxes known as "automatic-bottom boxes". In short, because of the design of this type of box the point at which the bottom of the box lies will have when it is folded flat, five thicknesses of cardboard while the point where the top of the box lies will have only two.

Hence, when the boxes are stacked for handling or storage the stack that is formed will have a tendency to topple if all the packs of boxes are stacked in the same direction.

One solution that has been employed by people working with a folder-gluer involves turning the various packs of boxes over manually so that they are disposed in a top to bottom relationship, just as one would stack ring-files, for example.

Since folder-gluers are machines which work at a fast rate, it becomes very difficult to turn over manually the folded boxes without reducing the speed of production of the machine. This aspect of the problem is even more apparent when it is considered that the sizes and shapes of the folded boxes may be large and that the packs accordingly become heavy and difficult to handle.

SUMMARY OF THE INVENTION

It becomes appropriate, therefore, to develop apparatus for automatic stacking of folded boxes which does not slow down production of a folder-gluer, for example, while forming stacks which are not thicker on one side than the other or in effect have a section of substantially rectangular shape.

Accordingly it is an object of the present invention to provide a box stacking apparatus which may selectively stack groups of folded boxes in alternately disposed directions to balance out the stack, and avoid toppling of the stack.

It is a further object to provide apparatus including shiftable conveyor means for conveying folded boxes to different stacks and means for turning over the folded boxes of a first stack to integrate said boxes with the folded boxes of a second stack with the stacks being disposed in opposite directions.

By way of summary the apparatus herein comprises at least two stations for receiving the folded boxes for the purpose of arranging them in packs, these stations being located in two different planes, means for turning over the pack formed in one of the stations, with such means pivoting about an axis so as to bring the said pack above the pack formed in the other station. It further comprises support means pressing the pack of folded boxes during one portion of its turning-over trajectory so as to keep it compact, means for guiding the pack to contain it during its movement and means for removal of the stacks formed of at least two packs of folded boxes placed top to bottom, and the control of the means for turning over the pack being accomplished and timed in such a manner that the arrival of the boxes at their respective stations is continuous.

Other objects and advantages of the invention will become more readily apparent when considered in connection with the description and the accompanying drawings.

DESCRIPTION OF A PREFERRED EMBODIMENT

Figure 1:
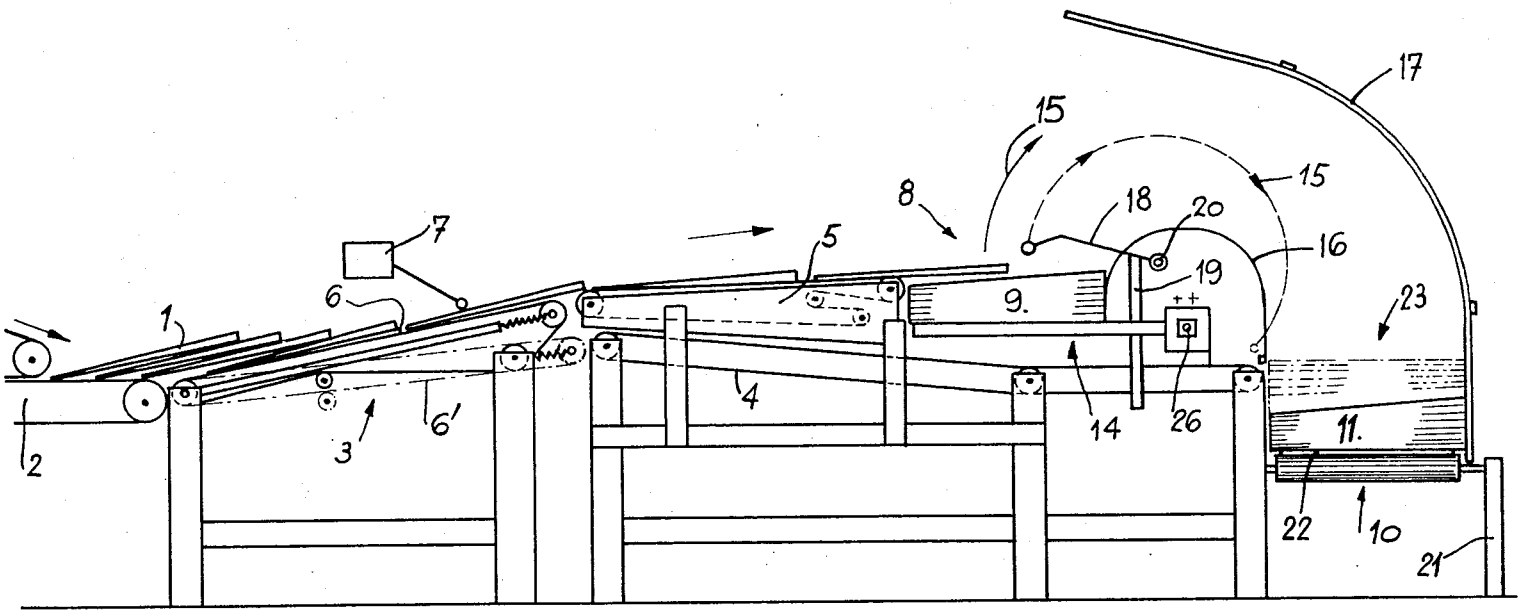
FIG. 1 is a diagrammatic view in elevation of a stacking device embodying the invention.

Referring now to the drawings in which identical reference characters refer to similar parts, FIG. 1 is a diagrammatic view in elevation of a stacking device fed by belt conveyors. Folded boxes 1 leave the receiver station 2 of a folder-gluer. They are intercepted by a conveyor 3 which is vertically movable and may be pivotally mounted at its front end (to the left as seen in FIG. 1). The conveyor 3 delivers the boxes 1 selectively onto the lower and upper conveyors 4 and 5 respectively. The movable conveyor 3 is constructed so as to be able to occupy selectively the positions 6 and 6'. The movement of the movable conveyor 3 from the position 6 (shown in full line) to the position 6' (shown in dash-dot line) is controlled by a device 7 for counting the folded boxes 1. When the required number of folded boxes 1 is reached the counting device 7 actuates by means of a pneumatic control (not shown) or other suitable means which effects the change of position of the movable conveyor 3. In the position 6 the movable conveyor 3 feeds the upper conveyor 5 with folded boxes 1. The upper conveyor 5 moves the folded boxes 1 to the station 8 in which the folded boxes 1 are stacked to form a first pack 9. In the position 6' the movable conveyor 3 feeds the lower conveyor 4 with folded boxes 1. The lower conveyor 4 then moves the folded boxes 1 to the station 10 where they are stacked and form a second pack 11.

The station 8 comprises a grid 12 formed of longitudinally extending members 13. The grid 12 is adjustable in width by moving the members 13 along shafts 24 according to the shape and size of the folded boxes 1 (see FIG. 2). A turnover support 14 is arranged substantially parallel to and outside the grid 12 and at the rear thereof. It is pivotally mounted on the axis 26 so that it may discharge the pack 9 in the direction of the arrows 15 so as to lay the pack 9 turned over 180° in the station 10 where a pack 11 will have previously been formed. The stack 23 thus formed will have practically rectangular section because one of the packs is reversed with respect to the other. In other words the stack 23 will not be lopsided so to speak.

In order to turn over the pack 9 it is necessary to provide an inner guide 16, a portion of which is of approximately cylindrical shape centered about the pivotal axis 26 and extending between the stations 8 and 10. The guide 16 may be in the form of one or more shield-like members. A portion of the inner guide 16 serves as a front stop for the folded boxes 1 which are conveyed to station 8 to be stacked therein. An outer shield-like guide 17 which may be produced from a material which is easily deformed for adapting it to the various shapes and sizes of the packs confines the pack 9 while it is being turned over. A portion of the outer guide 17 serves as a front stop for the folded boxes 1 which are conveyed to station 10.

In order to ensure compactness of the pack 9 during its movement from one station to the other a spring biased arm member or support lever 18 presses on it over about 150° of its path of movement. The arm member 18 is stopped at a certain distance from the pack 9 by an adjustable stop 19 so as to enable stacking of the folded boxes 1. At the end of the turn over path the pack 9 is automatically released from the restraining action of the arm member 18 and falls by its own weight into the station 10. The arm member 18 presses on the pack 9 under the action of a torsion spring 41 and pivots about the point 20.

The station 10 is located in the discharge means 21 which comprises a belt 22. The discharge means 21 are actuated periodically every time a stack 23 formed of two packs 9 and 11 placed top to bottom has been made up.

Figure 2:
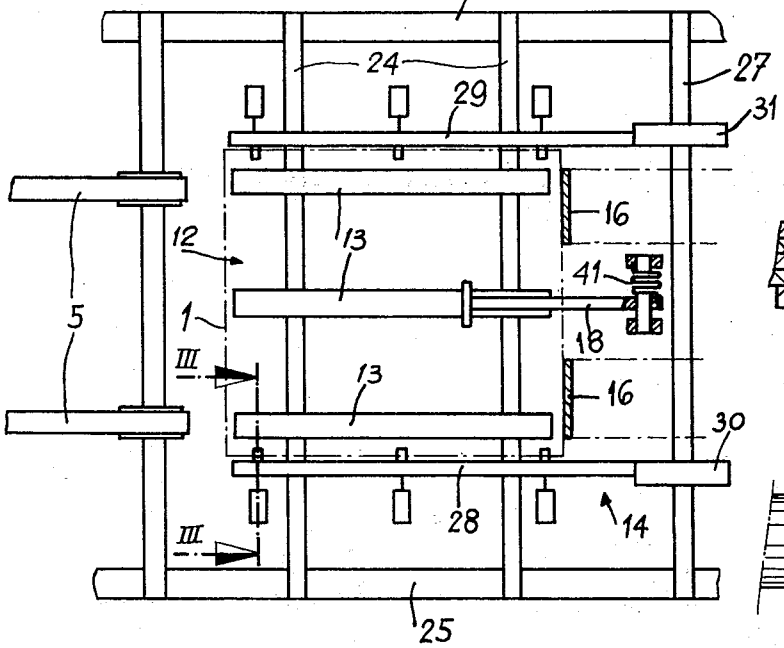
FIG. 2 is a plan view of the first station of the stacking device of FIG. 1.

FIG. 2 shows a plan view of the first station for stacking folded boxes 1 supplied by the upper conveyor 5. The folded boxes 1 (here shown in a dash-dot line) are stacked on the grid 12 formed of the members 13. The latter are transversely movable along the spindles 24 fixed in the frame members 25 and 26 to adjust the width of the grid 12. The turn over support 14 includes two arms 28 and 29 fixed to the shaft 27 by means of the bearings 30 and 31. These two arms 28 and 29 are also movable transversely to accommodate various shapes and sizes of the folded boxes 1. The folded boxes 1 come to rest against the bottom portion of the inner guide 16 and are held against lateral displacement by the arms 28 and 29 of the turn over support 14.

Figure 3:
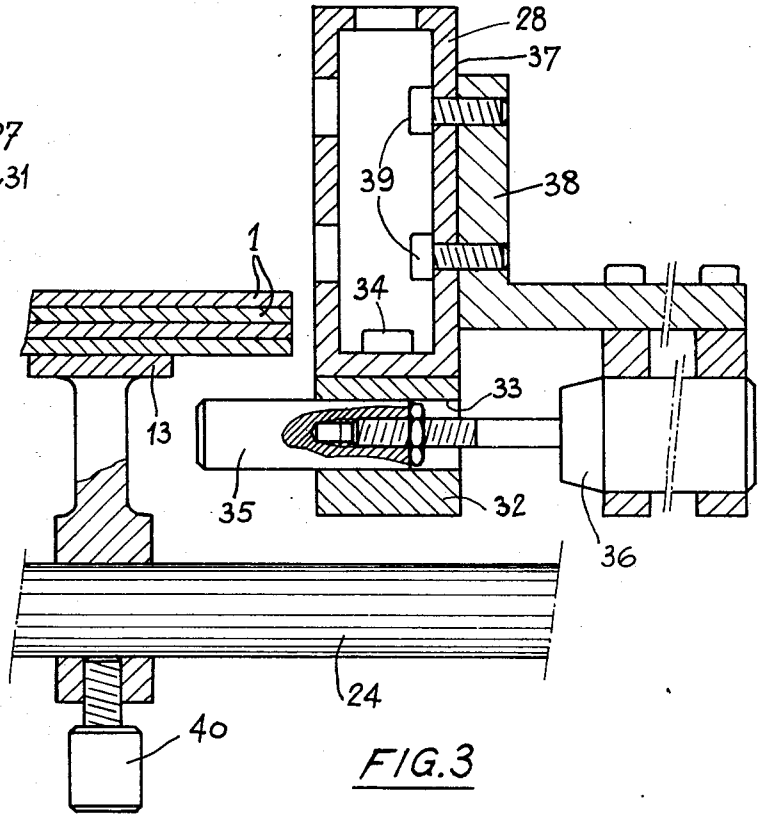
FIG. 3 is a partial vertical section taken along line III—III of FIG. 2.

FIG. 3 is a section along line III—III in FIG. 2 in which the arm 28 of the turn over support 14 is shown. A block 32 having a bore 33 is fixed by means of screws 34 to the bottom portion of the arm 28. A rod 35 intended for lifting the pack 9 slides in the bore 33. The movement of the rod 35 is controlled by a pneumatic piston 36 attached to the wall 37 of the arm 28 by means of angle iron 38 and screws 39. A similar construction is formed on the arm 29. The members 13 of the grid 12 are locked in position along the shaft 24 by means of set screws 40 or other suitable means.

Figure 4:
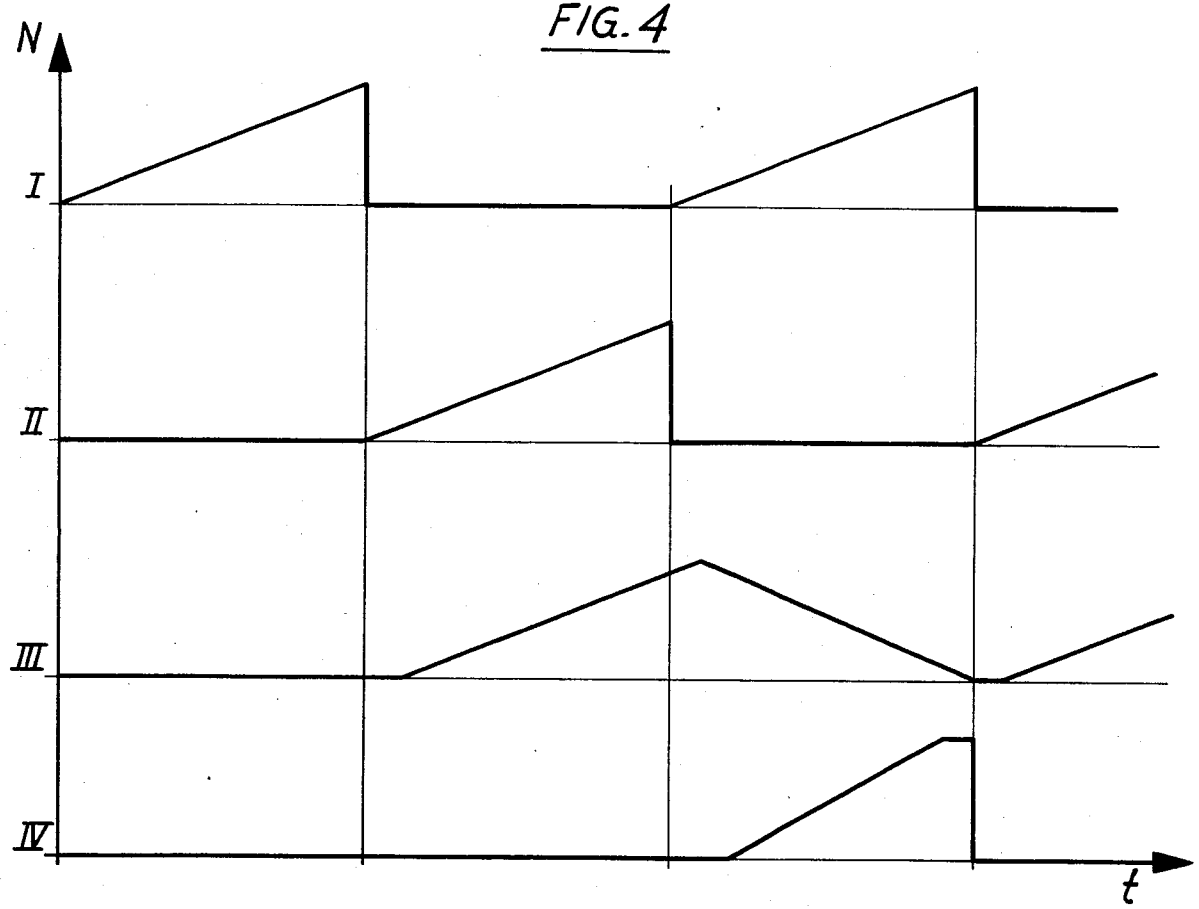
FIG. 4 represents a diagram illustrating the working cycle of the device.

FIG. 4 shows a diagram illustrating the working cycle of the stacking device. This diagram shows on the abscissa time $t$ and on the ordinate the number of boxes N. Four cycles I to IV are illustrated. They are as follows: Cycle I corresponds to the forming of the pack 9 in the station 8, Cycle II to the forming of the pack 11 in the station 10, Cycle III to the motion of the turn over support 14, and Cycle IV to the motion of the discharge means 21.

The operation of the apparatus may be summarized briefly as follows: Operation commences with the stacking of a certain number of folded boxes 1 in the station 8. Once this predetermined number of folded boxes 1 is reached, the movable conveyor 3 changes position so that the folded boxes 1 are deposited and stacked in the station 10. About 0.5 seconds after this change of position of the movable conveyor 3, turning over of the pack 9 commences. This turning over is carried out in a continuous manner during the time of formation of the stack 11 in the station 10, which is why, having started with about 0.5 seconds delay, it is going to finish after the stack 11 has been formed.

However, as soon as forming of the stack 11 is finished, the movable conveyor 3 is actuated so as to feed the station 8. When the turn over support 14 has finished its travel, an electro-pneumatic device (not shown) will retract the rods 35 so that the return travel of the turn over support 14 can be carried out independently of the loading of the station 8. When the turn over support 14 has returned to its starting position the rods 35 will again be pushed forward so as to enable driving of the next pack. Shortly after the end of the travel of the turn over support 14 the discharge belt 22 will be actuated so that discharge of the stack 23 is ended before the end of the formation of a new pack in the station 8.

While a preferred embodiment of the invention has been disclosed it will be appreciated that this has been shown by way of example only, and the invention is not to be limited thereto as other variations will be apparent to those skilled in the art and the invention is to be given its fullest possible interpretation within the terms of the following claims.

What is claimed is:

1. Apparatus for receiving folded boxes at the output from a machine and stacking the folded boxes comprising:

first and second laterally displaced box receiving stations for stacking folded boxes in first and second packs, respectively, said second station also functioning as a box sending station;

folded box conveyor means adjustable to alternately deliver boxes to each of said first and second receiving stations;

box turning over means for turning over said first pack of boxes at said first station and slowly moving said first pack of boxes in a vertical plane about a first axis to said second station while boxes are being stacked in said second station and placing the first pack on said second pack to form a balanced stack when stacking in said second station is completed; and means for removing said balanced stack from said second station.

2. The apparatus of claim 1 in which a spring biased support means retains said first pack of boxes against said box turning over means during only a portion of the movement on the vertical plane, said support means being rotatable about an independent stationary axis displaced rearwardly from said first axis with respect to movement of said boxes on the conveyor means.

3. The apparatus of claim 1 including box support means to retain said first pack of boxes in a pack during the turning over process.

4. The apparatus of claim 3 wherein said support means is spring biased.

5. The apparatus of claim 3 wherein said box support means comprises a lever member which rotates through an arc of approximately 150° during a pack turning operation.

6. The apparatus of claim 3 wherein said box turning over means are arranged to pivot about a first horizontal axis disposed perpendicular to the direction of movement of the folded boxes into the stacking device; and said box support means including a second horizontal axis about which said support means pivots, said second horizontal axis being disposed parallel to and spaced from said first horizontal axis about which said turning over means pivots.

7. The apparatus of claim 1 wherein
guide means are included for confining a pack of folded boxes during the movement from one receiving station to the other.

8. The apparatus of claim 7 wherein
said guide means includes inner and outer guide means.

9. The apparatus of claim 8 wherein
said inner guide means is in the form of a substantially cylindrical shaped arch means centered approximately on the pivotal axis of said box turning over means.

10. The apparatus of claim 8 wherein
said outer guide means comprises a flexible shield-like member adapted to position itself in accordance with the varying shapes and sizes of the folded box packs.

11. The apparatus of claim 8 wherein
said inner guide means is in the form of substantially cylindrical shaped arch means centered approximately on the pivotal axis of said turning over means; and
said outer guide means comprises a flexible shield-like member adapted to position itself in accordance with the varying shapes and sizes of the folded packs of boxes.

12. The apparatus of claim 1 wherein said means for removing comprises a sequentially controlled conveyor belt.

13. Apparatus for receiving folded boxes at the output from a machine and stacking the folded boxes comprising:

a. first and second laterally and vertically displaced stations for stacking and holding folded boxes in first and second packs respectively;
b. first and second conveyors for delivering boxes to said first and second receiving stations;
c. a third conveyor means alternately feeding boxes to said first and second conveyors;
d. a box turning over means adjacent said first station for turning over said first pack of boxes at said first station and moving said first pack of boxes in a vertical plane about a first axis to said second station to place said first pack on said second pack of boxes to form a balanced stack;
e. a spring-biased support means retaining said first pack of boxes against said box turning over means, said support means being mounted on a separate nonmovable axis displaced with respect to said first axis, an end of said support means releasing from said first pack of boxes near said second pack of boxes due to a displacement between the first axis and support means axis, and
f. means for removing said balanced stack from said second station.

* * * * *